US009017527B2

(12) United States Patent
Wiedmeyer et al.

(10) Patent No.: US 9,017,527 B2
(45) Date of Patent: Apr. 28, 2015

(54) ELECTROLYTIC OXIDE REDUCTION SYSTEM

(75) Inventors: Stanley G. Wiedmeyer, Glen Ellyn, IL (US); Laurel A. Barnes, Chicago, IL (US); Mark A. Williamson, Naperville, IL (US); James L. Willit, Batavia, IL (US); John F. Berger, Wilmington, NC (US)

(73) Assignee: GE-Hitachi Nuclear Energy Americas LLC, Wilmington, NC (US)

( * ) Notice: Subject to any disclaimer, the term of this patent is extended or adjusted under 35 U.S.C. 154(b) by 455 days.

(21) Appl. No.: 12/978,027

(22) Filed: Dec. 23, 2010

(65) Prior Publication Data

US 2012/0160666 A1 Jun. 28, 2012

(51) Int. Cl.

| | |
|---|---|
| ***C25C 7/02*** | (2006.01) |
| ***C25C 3/34*** | (2006.01) |
| ***C25C 7/06*** | (2006.01) |

(52) U.S. Cl.
CPC .... *C25C 3/34* (2013.01); *C25C 7/06* (2013.01)

(58) Field of Classification Search
USPC ..... 204/261, 67, 198, 225, 1.11; 205/47, 205/376, 336, 137; 384/107; 228/56.2
See application file for complete search history.

(56) References Cited

U.S. PATENT DOCUMENTS

| | | | |
|---|---|---|---|
| 422,139 | A | 2/1890 | Maxon |
| 658,891 | A | 10/1900 | Carmichael |
| 2,089,738 | A | 8/1935 | Elmer |
| 2,194,444 | A | 3/1940 | Hulse et al. |
| 2,766,198 | A | 10/1956 | Carosella |
| 2,800,219 | A | 7/1957 | Carroll |
| 2,913,380 | A | 11/1959 | Gullett |
| 2,967,142 | A | 1/1961 | Oliver |
| 3,531,269 | A | 9/1970 | Grady |
| 3,562,131 | A | 2/1971 | Jasberg et al. |
| 3,645,708 | A | 2/1972 | Grady |
| 3,697,404 | A | 10/1972 | Paige |
| 3,972,794 | A | 8/1976 | Lamm |

(Continued)

FOREIGN PATENT DOCUMENTS

| | | |
|---|---|---|
| AU | 622 994 B2 | 4/1992 |
| CA | 1 142 123 | 3/1983 |

(Continued)

OTHER PUBLICATIONS

Jeong et al., ("Electrolytic production of metallic Uranium from U3O8 in a 20-kg batch scale reactor", Journal of Radioanalytical and Nuclear Chemistry, vol. 286, No. 2 (2006) 349-356).I.*

(Continued)

*Primary Examiner* — Keith Hendricks
*Assistant Examiner* — Stefanie S Wittenberg
(74) *Attorney, Agent, or Firm* — Harness, Dickey & Pierce, P.L.C.

(57) ABSTRACT

An electrolytic oxide reduction system according to a non-limiting embodiment of the present invention may include a plurality of anode assemblies, a plurality of cathode assemblies, and a lift system configured to engage the anode and cathode assemblies. The cathode assemblies may be alternately arranged with the anode assemblies such that each cathode assembly is flanked by two anode assemblies. The lift system may be configured to selectively engage the anode and cathode assemblies so as to allow the simultaneous lifting of any combination of the anode and cathode assemblies (whether adjacent or non-adjacent).

21 Claims, 7 Drawing Sheets

(56) References Cited

U.S. PATENT DOCUMENTS

| | | | | |
|---|---|---|---|---|
| 4,013,329 | A | 3/1977 | Hugin | |
| 4,023,673 | A | 5/1977 | Hansen | |
| 4,025,400 | A | 5/1977 | Cook et al. | |
| 4,039,403 | A | 8/1977 | Astley et al. | |
| 4,073,703 | A | 2/1978 | Kinosz | |
| 4,148,392 | A | 4/1979 | Larson et al. | |
| 4,203,531 | A * | 5/1980 | Reichel et al. | 228/56.2 |
| 4,326,937 | A * | 4/1982 | Neumeier et al. | 204/198 |
| 4,437,968 | A | 3/1984 | Elliott, Jr. | |
| 4,492,621 | A * | 1/1985 | Stubb | 204/261 |
| 4,608,135 | A | 8/1986 | Brown | |
| 4,668,353 | A | 5/1987 | Smith et al. | |
| 4,851,098 | A * | 7/1989 | Kimura et al. | 204/198 |
| 4,863,580 | A | 9/1989 | Epner | |
| 4,880,506 | A | 11/1989 | Ackerman et al. | |
| 4,946,026 | A | 8/1990 | Rickman | |
| 5,015,342 | A * | 5/1991 | Ginatta et al. | 205/397 |
| 5,415,742 | A * | 5/1995 | La Camera et al. | 205/336 |
| 5,454,914 | A | 10/1995 | Gay | |
| 5,531,868 | A | 7/1996 | Miller et al. | |
| 5,582,706 | A | 12/1996 | Grantham et al. | |
| 5,689,538 | A | 11/1997 | Bonhomme | |
| 5,770,034 | A | 6/1998 | Jansen et al. | |
| 5,855,749 | A | 1/1999 | Kohut et al. | |
| 5,935,394 | A | 8/1999 | Sivilotti et al. | |
| 6,142,291 | A | 11/2000 | Schulze et al. | |
| 6,540,902 | B1 | 4/2003 | Redey et al. | |
| 6,689,260 | B1 | 2/2004 | Ahluwalia et al. | |
| 6,821,405 | B1 * | 11/2004 | Marttila | 205/137 |
| 6,866,768 | B2 * | 3/2005 | Barnett et al. | 205/376 |
| 7,011,736 | B1 | 3/2006 | Miller et al. | |
| 7,090,760 | B2 | 8/2006 | Seo et al. | |
| 7,097,747 | B1 | 8/2006 | Herceg et al. | |
| 7,449,635 | B2 | 11/2008 | Wiant | |
| 7,563,982 | B2 | 7/2009 | Kimmel | |
| 7,638,026 | B1 | 12/2009 | Willit et al. | |
| 7,799,185 | B1 | 9/2010 | Willit | |
| 8,248,760 | B2 | 8/2012 | Abrahamsen et al. | |
| 2004/0007466 | A1 | 1/2004 | Seo et al. | |
| 2004/0011661 | A1 | 1/2004 | Bradford et al. | |
| 2004/0134785 | A1 | 7/2004 | Gay et al. | |
| 2004/0168932 | A1 | 9/2004 | Wang | |
| 2005/0067291 | A1 | 3/2005 | Haiki et al. | |
| 2005/0121319 | A1 | 6/2005 | Dufresne | |
| 2005/0205428 | A1 * | 9/2005 | Dees et al. | 205/43 |
| 2005/0233634 | A1 | 10/2005 | Kollmann | |
| 2006/0067291 | A1 | 3/2006 | Nakata | |
| 2006/0091017 | A1 | 5/2006 | Lam | |
| 2006/0096853 | A1 | 5/2006 | King | |
| 2007/0082551 | A1 | 4/2007 | Oesterhaus | |
| 2007/0295601 | A1 * | 12/2007 | Bayer | 204/225 |
| 2008/0128270 | A1 | 6/2008 | Hiraiwa et al. | |
| 2008/0142374 | A1 | 6/2008 | Iwama et al. | |
| 2008/0152270 | A1 * | 6/2008 | Engesser et al. | 384/107 |
| 2009/0050483 | A1 | 2/2009 | Li | |
| 2009/0152124 | A1 | 6/2009 | Ashford et al. | |
| 2010/0276259 | A1 | 11/2010 | Phalen | |
| 2011/0100328 | A1 | 5/2011 | Paul | |
| 2011/0180409 | A1 | 7/2011 | Willit et al. | |

FOREIGN PATENT DOCUMENTS

| | | | |
|---|---|---|---|
| CN | 1186528 | A | 7/1998 |
| CN | 1354808 | A | 6/2002 |
| DE | 26 00 344 | | 7/1977 |
| DE | 3837572 | | 5/1989 |
| DE | 19845258 | | 3/2000 |
| EP | 0 286 092 | | 10/1988 |
| EP | 0 736 929 | | 10/1996 |
| EP | 2224542 | | 9/2010 |
| GB | 284678 | | 11/1928 |
| GB | 506590 | | 5/1939 |
| GB | 516775 | | 1/1940 |
| JP | H05279887 | | 10/1993 |
| JP | H0972991 | | 3/1997 |
| JP | 2006-308442 | | 11/2006 |
| WO | WO 02/066709 | | 8/2002 |
| WO | WO 2004/018737 | | 3/2004 |
| WO | WO 2004/031453 | | 4/2004 |
| WO | WO 2005/035404 | | 4/2005 |
| WO | WO 2006/007863 | | 1/2006 |
| WO | WO 2009/062005 | | 5/2009 |
| WO | WO 2010/080761 | | 7/2010 |

OTHER PUBLICATIONS

U.S. Appl. No. 12/978,005, filed Dec. 23, 2010.
U.S. Appl. No. 12/977,791, filed Dec. 23, 2010.
U.S. Appl. No. 12/977,916, filed Dec. 23, 2010.
U.S. Appl. No. 12/977,839, filed Dec. 23, 2010.
U.S. Appl. No. 13/335,139, filed Dec. 22, 2011.
U.S. Appl. No. 13/335,082, filed Dec. 22, 2011.
U.S. Appl. No. 13/335,209, filed Dec. 22, 2011.
U.S. Appl. No. 13/335,121, filed Dec. 22, 2011.
U.S. Appl. No. 13/335,140, filed Dec. 22, 2011.
U.S. Appl. No. 13/453,290, filed Apr. 23, 2012.
"Proceedings of GLOBAL 2005", Tsukuba, Japan, Oct. 9-13, 2005, Paper No. 488.
International Search Report dated Jan. 20, 2012 issued in PCT/US2011/053589.
International Search Report dated Feb. 6, 2012 issued in PCT/US2011/053872.
International Search Report dated May 11, 2012 issued in PCT/US2011/053871.
Steven D. Herrman, et al., "Electrolytic Reduction of Spent Oxide Fuel—Bench-Scale Test Results", Global 2005, INL/CON-05-00304, Paper No. 488, Oct. 2005.
International Search Report issued in connection with International Patent Application No. PCT/US2011/053878, Jan. 30, 2012.
International Search Report and Written Opinion issued in International Patent Application No. PCT/US2012/058663, issued Aug. 12, 2013.
International Search Report and Written Opinion issued in International Patent Application No. PCT/US2012/058531, issued Aug. 2, 2013.
European Search Report issued in European Patent Application No. 13163951.0, issued Aug. 29, 2013.
International Search Report and Written Opinion issued in International Patent Application No. PCT/US2012/058664, mailed Jul. 8, 2013.
International Search Report and Written Opinion issued in International Patent Application No. PCT/US2012/058659, mailed Jul. 5, 2013.
International Search Report and Written Opinion issued in International Patent Application No. PCT/US2012/058661, mailed Jul. 25, 2013.
Figueroa, J. et al., "GTRI Progress in Developing Pyrochemical Processes for Recovery of Fabrication Scrap and Reprocessing of Monolithic U-MO Fuel", RERTR 2011—International Meeting on Reduced Enrichment for Research and Test Reactors, Oct. 23, 2011, XP055071122.
International Panel on Fissile Materials (IPFM). "Spent Fuel from Nuclear Power Reactors: An Overview of a New Study by the International Panel on Fissile Materials" (Draft for Discussion). Jun. 2011, Edited by Harold Feiveson.
World Nuclear Association. "How uranium ore is made into nuclear fuel." Last accessed Oct. 10, 2014. <http://www.world-nuclear.org/Nuclear-Basics/How-is-uranium-ore-made-into-nuclear-fuel-/>.
Journeau, et al., "Physico-chemical analyses and solidification path reconstruction of multi-component oxidic spread melts." Materials Science and Engineering A. vol. 299. Feb. 15, 2001. pp. 249-266.
International Atomic Energy Agency (IAEA). "Storage and Disposal of Spent Fuel and High Level Radioactive Waste". Additional paper to the IAEA's Nuclear Technology Review (2006), pp. 1-11.
Morss, et al., "Cerium, uranium, and plutonium behavior in glass-bonded sodalite, a ceramic nuclear waste form." Journal of Alloys and Compounds. vols. 303-304. May 24, 2000. pp. 42-48.

(56) References Cited

OTHER PUBLICATIONS

Abraham, et al., "Metal waste forms from treatment of EBR-11 spent fuel." Argonne National Laboratory. Presented at Spectrum '98 Conference. Sep. 18, 1998, pp. 1-7.

Chinese office action issued in corresponding Chinese Application No. 201180061803.2, dated Jan. 5, 2015.

Chinese Office Action issued in corresponding Chinese Application No. 201180061829.7, dated Jan. 6, 2015.

* cited by examiner

ELECTROLYTIC OXIDE REDUCTION SYSTEM

FEDERALLY SPONSORED RESEARCH OR DEVELOPMENT

The present invention was made with Government support under contract number DE-AC02-06CH11357, which was awarded by the U.S. Department of Energy.

BACKGROUND

1. Field

The present invention relates to a system configured to perform an electrolytic process for reducing an oxide to its metallic form.

2. Description of Related Art

An electrochemical process may be used to recover metals from an impure feed and/or to extract metals from a metal-oxide. A conventional process typically involves dissolving a metal-oxide in an electrolyte followed by electrolytic decomposition or selective electrotransport to reduce the metal-oxide to its corresponding metal. Conventional electrochemical processes for reducing metal-oxides to their corresponding metallic state may employ a single step or multiple-step approach.

A multiple-step approach is typically used when a metal-oxide has a relatively low solubility in the electrolyte. The multiple-step approach may be a two-step process that utilizes two separate vessels. For example, the extraction of uranium from the uranium oxide of spent nuclear fuels includes an initial step of reducing the uranium oxide with lithium dissolved in a molten LiCl electrolyte so as to produce uranium and $Li_2O$ in a first vessel, wherein the $Li_2O$ remains dissolved in the molten LiCl electrolyte. The process then involves a subsequent step of electrowinning in a second vessel, wherein the dissolved $Li_2O$ in the molten LiCl is electrolytically decomposed to regenerate lithium. Consequently, the resulting uranium may be extracted, while the molten LiCl with the regenerated lithium may be recycled for use in the reduction step of another batch.

However, a multi-step approach involves a number of engineering complexities, such as issues pertaining to the transfer of molten salt and reductant at high temperatures from one vessel to another. Furthermore, the reduction of oxides in molten salts may be thermodynamically constrained depending on the electrolyte-reductant system. In particular, this thermodynamic constraint will limit the amount of oxides that can be reduced in a given batch. As a result, more frequent transfers of molten electrolyte and reductant will be needed to meet production requirements.

On the other hand, a single-step approach generally involves immersing a metal oxide in a compatible molten electrolyte together with a cathode and anode. By charging the anode and cathode, the metal oxide can be reduced to its corresponding metal through electrolytic conversion and ion exchange through the molten electrolyte. However, although a conventional single-step approach may be less complex than a multi-step approach, the metal yield is still relatively low.

SUMMARY

An electrolytic oxide reduction system according to a non-limiting embodiment of the present invention may include a plurality of anode assemblies, a plurality of cathode assemblies, and a lift system configured to engage the anode and/or cathode assemblies. Each anode assembly may include a plurality of anode rods having the same orientation and arranged so as to be within the same plane. The plurality of cathode assemblies may be alternately arranged with the plurality of anode assemblies such that each cathode assembly is flanked by two anode assemblies. Each cathode assembly may be in planar form. The lift system may be configured to selectively engage the plurality of anode and/or cathode assemblies so as to facilitate the simultaneous lifting of any combination of the plurality of anode and/or cathode assemblies that are to be removed while allowing one or more of the plurality of anode and/or cathode assemblies that are not to be removed to remain in place.

BRIEF DESCRIPTION OF THE DRAWINGS

The various features and advantages of the non-limiting embodiments herein may become more apparent upon review of the detailed description in conjunction with the accompanying drawings. The accompanying drawings are merely provided for illustrative purposes and should not be interpreted to limit the scope of the claims. The accompanying drawings are not to be considered as drawn to scale unless explicitly noted. For purposes of clarity, various dimensions of the drawings may have been exaggerated.

DETAILED DESCRIPTION

Figure 1:
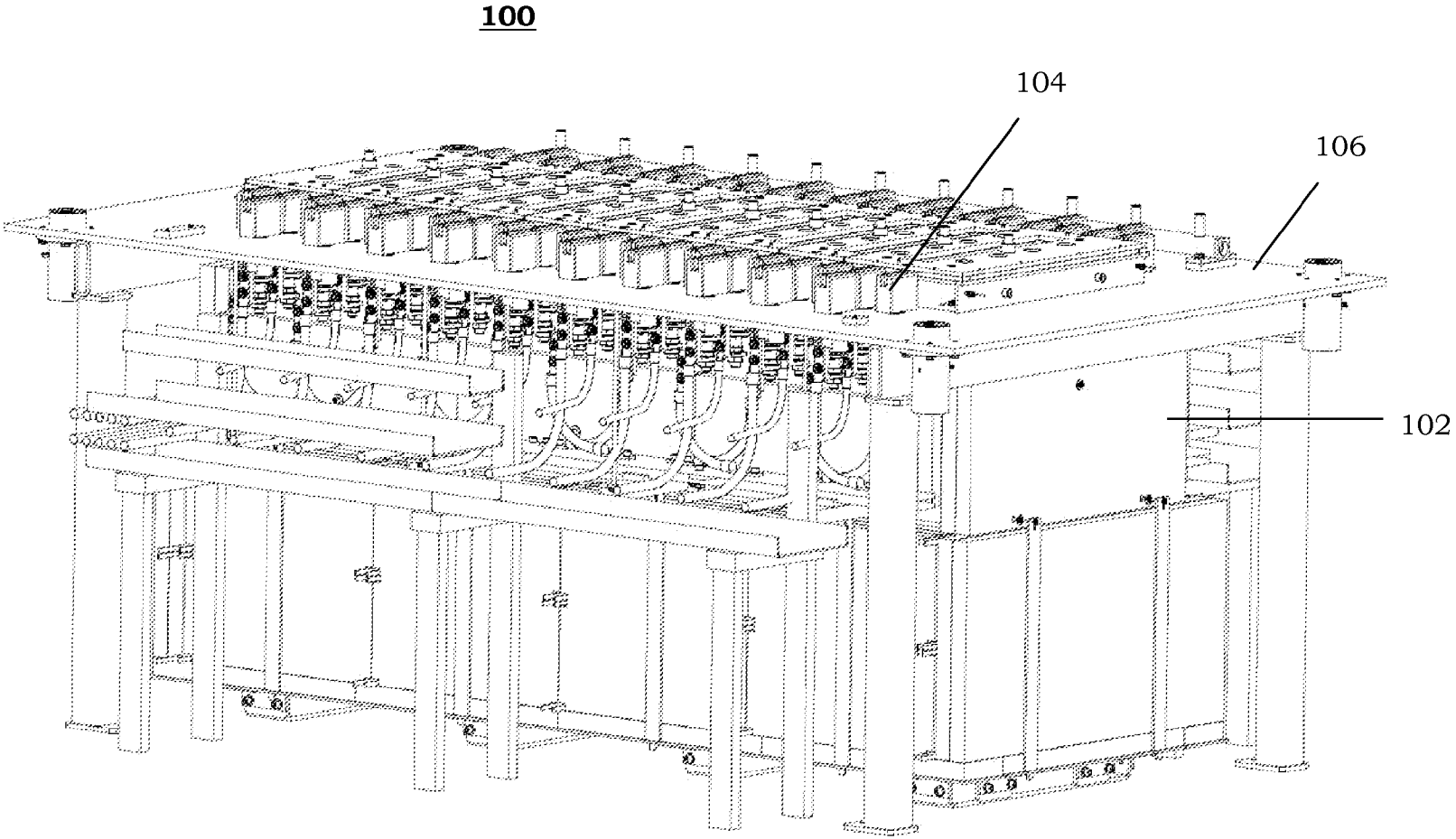
FIG. 1 is a perspective view of an electrolytic oxide reduction system according to a non-limiting embodiment of the present invention.

It should be understood that when an element or layer is referred to as being "on," "connected to," "coupled to," or "covering" another element or layer, it may be directly on, connected to, coupled to, or covering the other element or layer or intervening elements or layers may be present. In contrast, when an element is referred to as being "directly on," "directly connected to," or "directly coupled to" another element or layer, there are no intervening elements or layers present. Like numbers refer to like elements throughout the specification. As used herein, the term "and/or" includes any and all combinations of one or more of the associated listed items.

It should be understood that, although the terms first, second, third, etc. may be used herein to describe various elements, components, regions, layers and/or sections, these elements, components, regions, layers, and/or sections should not be limited by these terms. These terms are only used to distinguish one element, component, region, layer, or section from another region, layer, or section. Thus, a first element, component, region, layer, or section discussed below could be termed a second element, component, region, layer, or section without departing from the teachings of example embodiments.

Spatially relative terms (e.g., "beneath," "below," "lower," "above," "upper," and the like) may be used herein for ease of description to describe one element or feature's relationship to another element(s) or feature(s) as illustrated in the figures. It should be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the term "below" may encompass both an orientation of above and below. The device may be otherwise oriented (rotated 90 degrees or at other orientations) and the spatially relative descriptors used herein interpreted accordingly.

The terminology used herein is for the purpose of describing various embodiments only and is not intended to be limiting of example embodiments. As used herein, the singular forms "a," "an," and "the" are intended to include the plural forms as well, unless the context clearly indicates otherwise. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

Example embodiments are described herein with reference to cross-sectional illustrations that are schematic illustrations of idealized embodiments (and intermediate structures) of example embodiments. As such, variations from the shapes of the illustrations as a result, for example, of manufacturing techniques and/or tolerances, are to be expected. Thus, example embodiments should not be construed as limited to the shapes of regions illustrated herein but are to include deviations in shapes that result, for example, from manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the figures are schematic in nature and their shapes are not intended to illustrate the actual shape of a region of a device and are not intended to limit the scope of example embodiments.

Unless otherwise defined, all terms (including technical and scientific terms) used herein have the same meaning as commonly understood by one of ordinary skill in the art to which example embodiments belong. It will be further understood that terms, including those defined in commonly used dictionaries, should be interpreted as having a meaning that is consistent with their meaning in the context of the relevant art and will not be interpreted in an idealized or overly formal sense unless expressly so defined herein.

An electrolytic oxide reduction system according to a non-limiting embodiment of the present invention is configured to facilitate the reduction of an oxide to its metallic form so as to permit the subsequent recovery of the metal. Generally, the electrolytic oxide reduction system includes a plurality of anode assemblies, an anode shroud for each of the plurality of anode assemblies, a plurality of cathode assemblies, and a power distribution system for the plurality of anode and cathode assemblies. However, it should be understood that the electrolytic oxide reduction system is not limited thereto and may include other components that may not have been specifically identified herein.

In addition to the disclosure herein, the anode shroud may be as described in related U.S. application Ser. No. 12/977,791; filed on even date herewith; entitled "ANODE SHROUD FOR OFF-GAS CAPTURE AND REMOVAL FROM ELECTROLYTIC OXIDE REDUCTION SYSTEM," the power distribution system may be as described in related U.S. application Ser. No. 12/977,839; filed on even date herewith; entitled "ANODE-CATHODE POWER DISTRIBUTION SYSTEMS AND METHODS OF USING THE SAME FOR ELECTROCHEMICAL REDUCTION," the anode assembly may be as described in related U.S. application Ser. No. 12/977,916; filed on even date herewith; entitled "MODULAR ANODE ASSEMBLIES AND METHODS OF USING THE SAME FOR ELECTROCHEMICAL REDUCTION," and the cathode assembly may be as described in related U.S. application Ser. No. 12/978,005; filed on even date herewith; entitled "MODULAR CATHODE ASSEMBLIES AND METHODS OF USING THE SAME FOR ELECTROCHEMICAL REDUCTION," the entire contents of each of which are hereby incorporated by reference. A table of the incorporated applications is provided below.

Related Applications Incorporated by Reference

| U.S. application Ser. No. | HDP/GE Ref. | Filing Date | Title |
|---|---|---|---|
| 12/977,791 | 8564-000224/US 24AR246135 | Filed on even date herewith | ANODE SHROUD FOR OFF-GAS CAPTURE AND REMOVAL FROM ELECTROLYTIC OXIDE REDUCTION SYSTEM |
| 12/977,839 | 8564-000225/US 24AR246136 | Filed on even date herewith | ANODE-CATHODE POWER DISTRIBUTION SYSTEMS AND METHODS OF USING THE SAME FOR ELECTROCHEMICAL REDUCTION |
| 12/977,916 | 8564-000226/US 24AR246138 | Filed on even date herewith | MODULAR ANODE ASSEMBLIES AND METHODS OF USING THE SAME FOR ELECTROCHEMICAL REDUCTION |
| 12/978,005 | 8564-000227/US 24AR246139 | Filed on even date herewith | MODULAR CATHODE ASSEMBLIES AND METHODS OF USING THE SAME FOR ELECTROCHEMICAL REDUCTION |

During the operation of the electrolytic oxide reduction system, the plurality of anode and cathode assemblies are immersed in a molten salt electrolyte. The molten salt electrolyte may be maintained at a temperature of about 650° C. (+/−50° C.), although example embodiments are not limited thereto. An electrochemical process is carried out such that a reducing potential is generated at the cathode assemblies, which contain the oxide feed material (e.g., metal oxide). Under the influence of the reducing potential, the oxygen (O) from the metal oxide (MO) feed material dissolves into the molten salt electrolyte as an oxide ion, thereby leaving the metal (M) behind in the cathode assemblies. The cathode reaction may be as follows:

$$MO+2e^{-}\rightarrow M+O^{2-}$$

At the anode assemblies, the oxide ion is converted to oxygen gas. The anode shroud of each of the anode assemblies may be used to dilute, cool, and remove the oxygen gas from the electrolytic oxide reduction system during the process. The anode reaction may be as follows:

$$O^{2-} \rightarrow \frac{1}{2}O_2 + 2e^-$$

In a non-limiting embodiment, the metal oxide may be uranium dioxide ($UO_2$), and the reduction product may be uranium metal. However, it should be understood that other types of oxides may also be reduced to their corresponding metals with the electrolytic oxide reduction system according to the present invention. Similarly, the molten salt electrolyte used in the electrolytic oxide reduction system according to the present invention is not particularly limited thereto and may vary depending of the oxide feed material to be reduced. Compared to prior art apparatuses, electrolytic oxide reduction system according to the present invention allows for a significantly greater yield of reduction product.

FIG. 1 is a perspective view of an electrolytic oxide reduction system according to a non-limiting embodiment of the present invention. Referring to FIG. 1, the electrolytic oxide reduction system 100 includes a vessel 102 that is designed to hold a molten salt electrolyte. Accordingly, the vessel 102 is formed of a material that can withstand temperatures up to about 700° C. so as to be able to safely hold the molten salt electrolyte. The vessel 102 may be externally heated and provided with longitudinal supports. The vessel 102 may also be configured for zone heating to allow for more efficient operation and recovery from process upsets. During operation of the electrolytic oxide reduction system 100, a plurality of anode and cathode assemblies 200 and 300 (e.g., FIG. 4) are arranged so as to be partially immersed in the molten salt electrolyte in the vessel 102. The anode and cathode assemblies 200 and 300 will be discussed in further detail in connection with FIGS. 2A-2B and 3.

Power is distributed to the anode and cathode assemblies 200 and 300 through the plurality of knife edge contacts 104. The knife edge contacts 104 are arranged in pairs on a glovebox floor 106 that is situated above the vessel 102. Each pair of the knife edge contacts 104 is arranged so as to be on opposite sides of the vessel 102. As shown in FIG. 1, the knife edge contacts 104 are arranged in alternating one-pair and two-pair rows, wherein the end rows consist of one pair of knife edge contacts 104.

The one-pair rows of knife edge contacts 104 are configured to engage the anode assemblies 200, while the two-pair rows are configured to engage the cathode assemblies 300. Stated more clearly, the plurality of knife edge contacts 104 are arranged such that an anode assembly 200 receives power from one power supply via one pair of knife edge contacts 104 (two knife edge contacts 104), while a cathode assembly 300 receives power from two power supplies via two pairs of knife edge contacts 104 (four knife edge contacts 104). With regard to the two pairs of knife edge contacts 104 for the cathode assembly 300, the inner pair may be connected to a low power feedthrough, while the outer pair may be connected to a high power feedthrough (or vice versa).

For instance, assuming the electrolytic oxide reduction system 100 is designed to hold eleven anode assemblies 200 and ten cathode assemblies 300 (although example embodiments are not limited thereto), twenty-two knife edge contacts 104 (11 pairs) will be associated with the eleven anode assemblies, while forty knife edge contacts 104 (20 pairs) will be associated with the ten cathode assemblies 300. As previously noted above, in addition to the disclosure herein, the power distribution system may be as described in related U.S. application Ser. No. 12/977,839; filed on even date herewith; entitled "ANODE-CATHODE POWER DISTRIBUTION SYSTEMS AND METHODS OF USING THE SAME FOR ELECTROCHEMICAL REDUCTION," the entire contents of which is hereby incorporated by reference.

The electrolytic oxide reduction system 100 may additionally include modular heat shields designed to limit heat loss from the vessel 102. The modular heat shields may have instrumentation ports configured to monitor current, voltage, and off-gas composition during process operations. Furthermore, a cooling channel and expansion joint may be disposed between the glovebox floor 106 and the vessel 102. The expansion joint may be C-shaped and made from 18 gauge sheet metal. The cooling channel may be secured beneath the glovebox floor 106 but above the expansion joint. As a result, despite the fact that the vessel 102 may reach temperatures of about 700° C., the cooling channel can remove heat from the expansion joint (which is secured to the top of the vessel 102), thereby keeping the glovebox floor 106 at a temperature of about 80° C. or less.

Figure 2A:
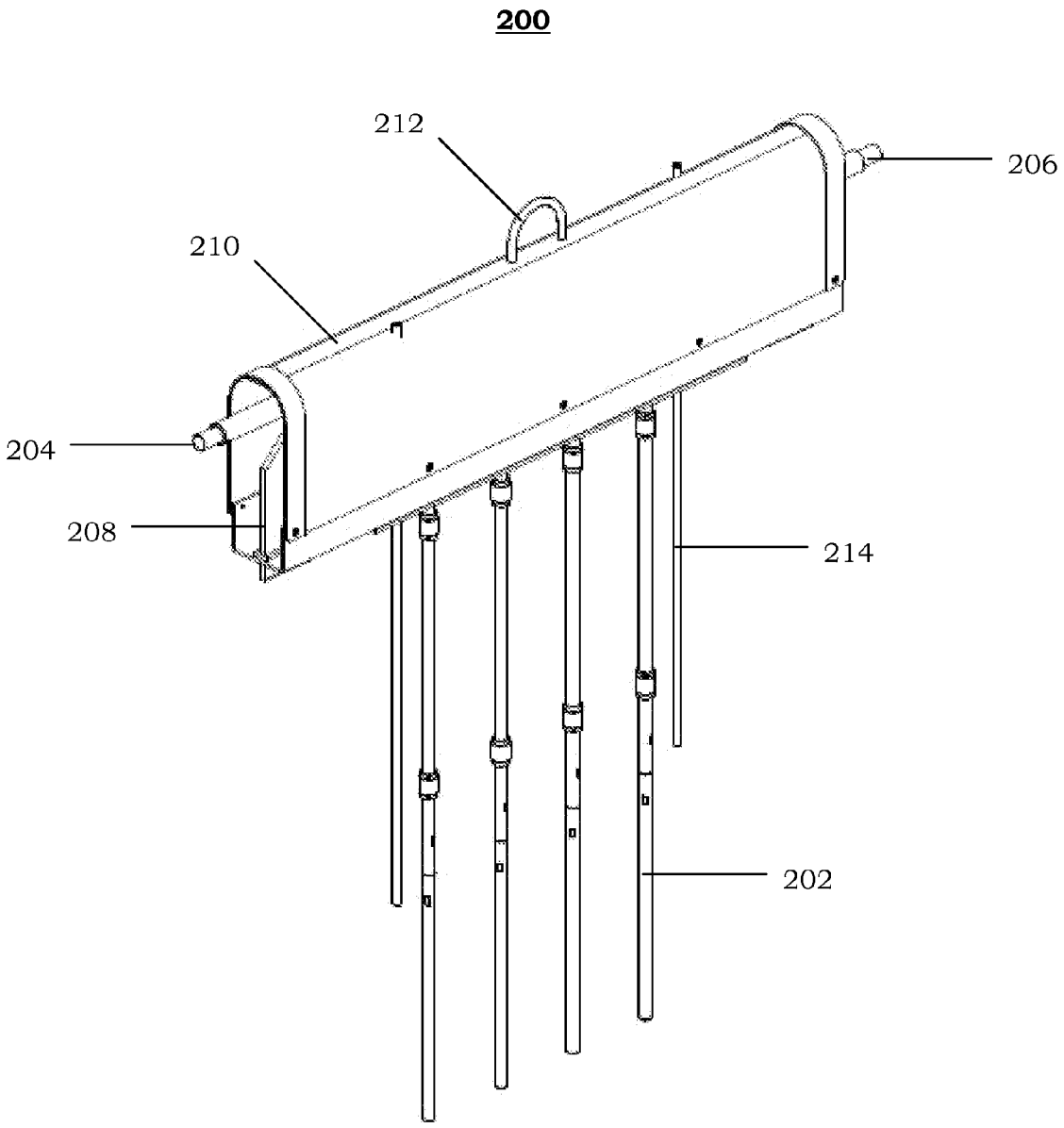
FIGS. 2A-2B are perspective views of an anode assembly for an electrolytic oxide reduction system according to a non-limiting embodiment of the present invention.
Figure 2B:
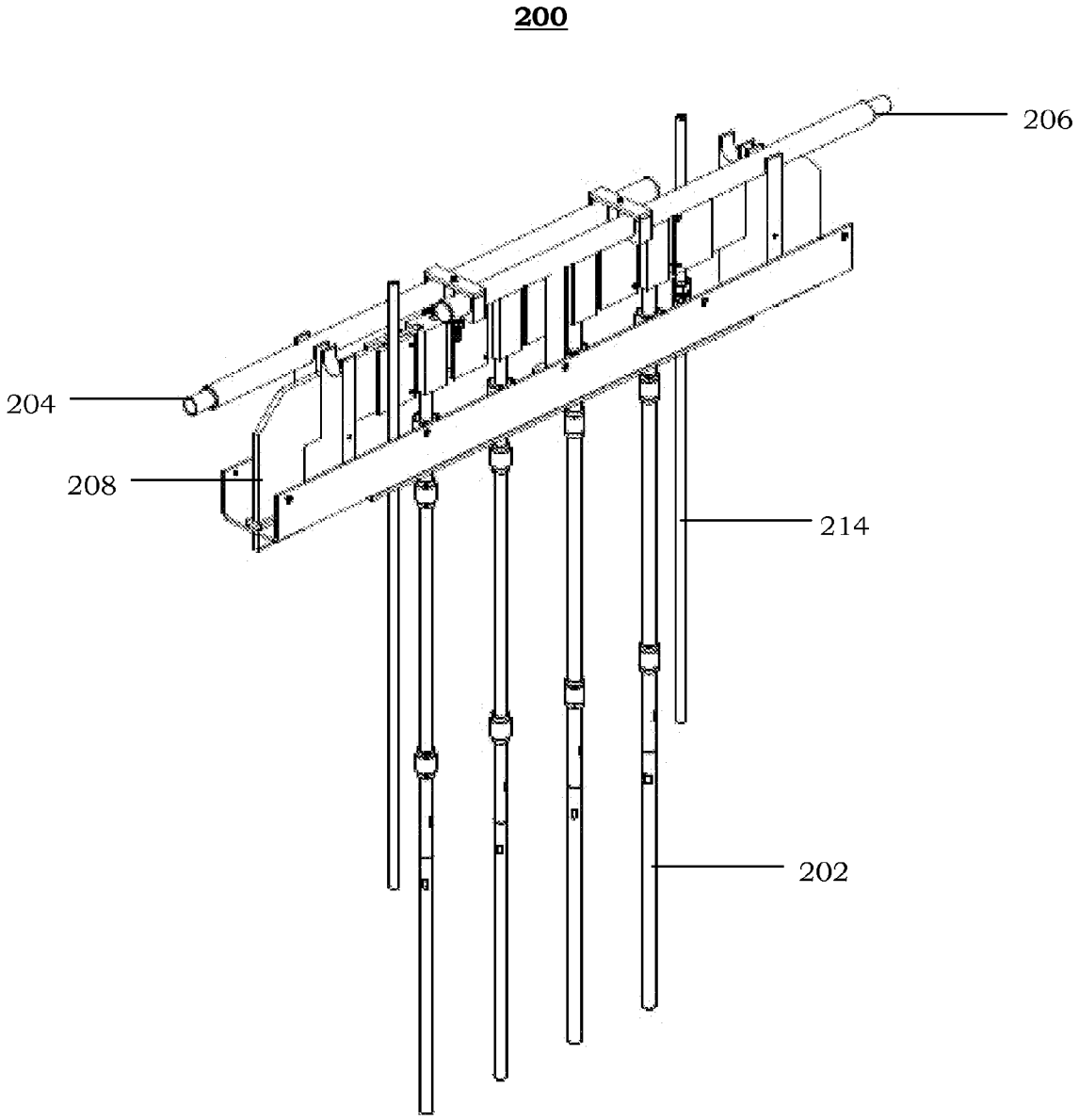

FIGS. 2A-2B are perspective views of an anode assembly for an electrolytic oxide reduction system according to a non-limiting embodiment of the present invention. Referring to FIGS. 2A-2B, the anode assembly 200 includes a plurality of anode rods 202 connected to an anode bus bar 208. The upper and lower portions of each anode rod 202 may be formed of different materials. For instance, the upper portion of the anode rod 202 may be formed of a nickel alloy, and the lower portion of the anode rod 202 may be formed of platinum, although example embodiments are not limited thereto. The lower portion of the anode rod 202 may sit below the molten salt electrolyte level during the operation of the electrolytic oxide reduction system 100 and may be removable to allow the lower portion to be replaced or changed to another material.

The anode bus bar 208 may be segmented to reduce thermal expansion, wherein each segment of the anode bus bar 208 may be formed of copper. The segments of the anode bus bar 208 may be joined with a slip connector. Additionally, the slip connector may attach to the top of an anode rod 202 to ensure that the anode rod 202 will not fall into the molten salt electrolyte. The anode assembly 200 is not to be limited by any of the above examples. Rather, it should be understood that other suitable configurations and materials may also be used.

When the anode assembly 200 is lowered into the electrolytic oxide reduction system 100, the lower end portions of the anode bus bar 208 will engage the corresponding pair of knife edge contacts 104, and the anode rods 202 will extend into the molten salt electrolyte in the vessel 102. Although four anode rods 202 are shown in FIGS. 2A-2B, it should be understood that example embodiments are not limited thereto. Thus, the anode assembly 200 may include less than four anode rods 202 or more than four anode rods 202, provided that sufficient anodic current is being provided to the electrolytic oxide reduction system 100.

During operation of the electrolytic oxide reduction system 100, the anode assembly 200 may be kept to a temperature of about 150° C. or less. To maintain the appropriate operating temperature, the anode assembly 200 includes a cooling line 204 that supplies a cooling gas and an off-gas line 206 that removes the cooling gas supplied by the cooling line 204 as well as the off-gas generated by the reduction process. The cooling gas may be an inert gas (e.g., argon) while the off-gas may include oxygen, although example embodiments are not limited thereto. As a result, the concentration and temperature of the off-gas may be lowered, thereby reducing its corrosiveness.

The cooling gas may be provided by the glovebox atmosphere. In a non-limiting embodiment, no pressurized gases external to the glovebox are used. In such a case, a gas supply can be pressurized using a blower inside the glovebox, and the off-gas exhaust will have an external vacuum source. All motors and controls for operating the gas supply may be located outside the glovebox for easier access and maintenance. To keep the molten salt electrolyte from freezing, the supply process can be configured so that the cooling gas inside the anode shroud will not be lower than about 610° C.

The anode assembly 200 may further include an anode guard 210, a lift bail 212, and instrumentation guide tubes 214. The anode guard 210 provides protection from the anode bus bar 208 and may also provide guidance for the insertion of the cathode assembly 300. The anode guard 210 may be formed of a metal and perforated to allow for heat loss from the top of the anode assembly 200. The lift bail 212 assists in the removal of the anode assembly 200. The instrumentation guide tubes 214 provide a port for the insertion of instrumentation into the molten salt electrolyte and/or gas space beneath the anode assembly 200. As previously noted above, in addition to the disclosure herein, the anode assembly may be as described in related U.S. application Ser. No. 12/977,916; filed on even date herewith; entitled "MODULAR ANODE ASSEMBLIES AND METHODS OF USING THE SAME FOR ELECTROCHEMICAL REDUCTION," the entire contents of which is hereby incorporated by reference.

The electrolytic oxide reduction system 100 may further include an anode shroud to facilitate the cooling of the anode assembly 200 as well as the removal of the off-gas generated by the reduction process. As previously noted above, in addition to the disclosure herein, the anode shroud may be as described in related U.S. application Ser. No. 12/977,791; filed on even date herewith; entitled "ANODE SHROUD FOR OFF-GAS CAPTURE AND REMOVAL FROM ELECTROLYTIC OXIDE REDUCTION SYSTEM," the entire contents of which is hereby incorporated by reference.

Figure 3:
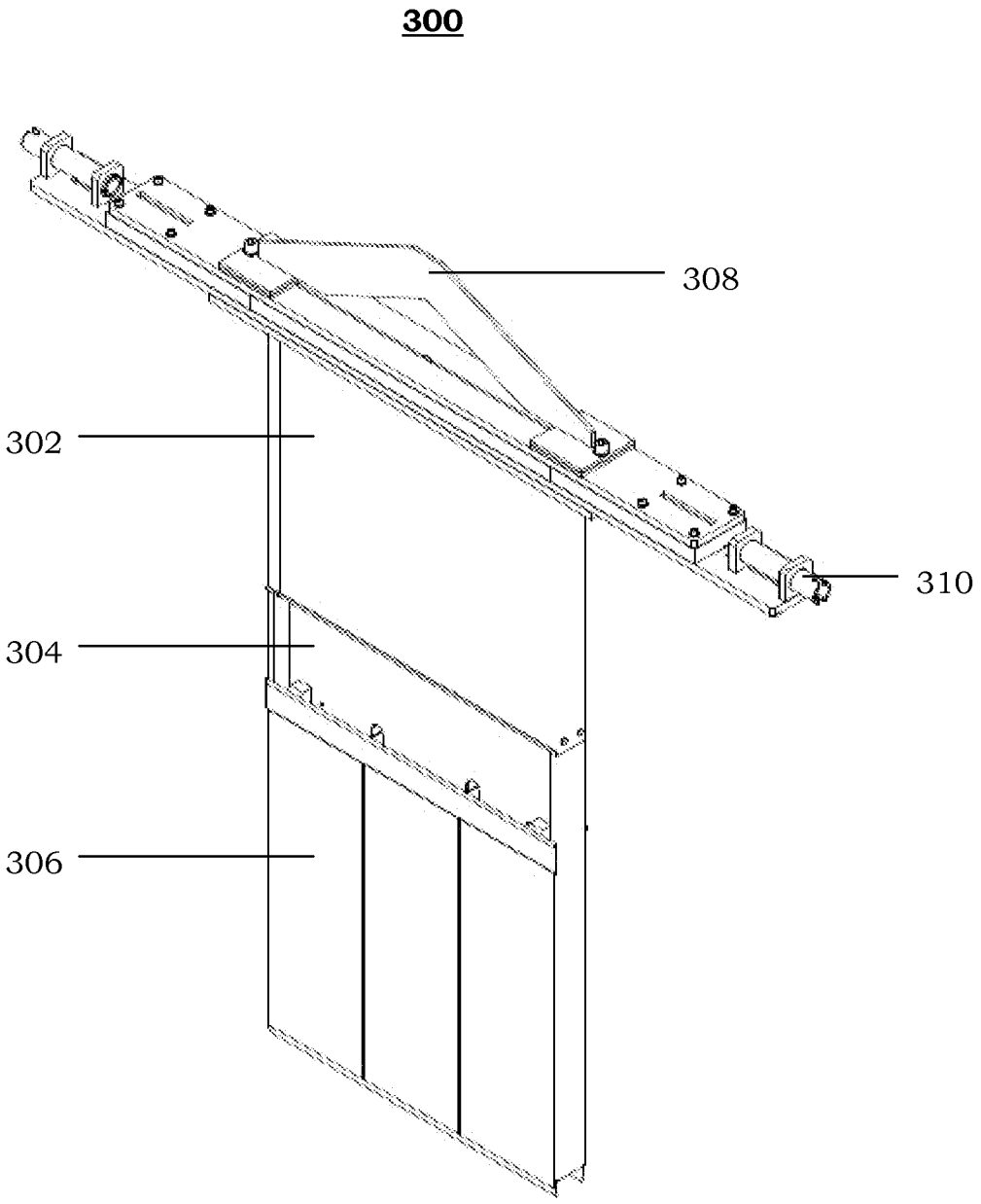
FIG. 3 is a perspective view of a cathode assembly for an electrolytic oxide reduction system according to a non-limiting embodiment of the present invention.

FIG. 3 is a perspective view of a cathode assembly for an electrolytic oxide reduction system according to a non-limiting embodiment of the present invention. Referring to FIG. 3, the cathode assembly 300 is designed to contain the oxide feed material for the reduction process and includes an upper basket 302, a lower basket 306, and a cathode plate 304 housed within the upper and lower baskets 302 and 306. When assembled, the cathode plate 304 will extend from a top end of the upper basket 302 to a bottom end of the lower basket 306. The side edges of the cathode plate 304 may be hemmed to provide rigidity. A reverse bend may also be provided down the center of the cathode plate 304 for added rigidity. The lower basket 306 may be attached to the upper basket 302 with four high strength rivets. In the event of damage to either the lower basket 306 or the upper basket 302, the rivets can be drilled out, the damaged basket replaced, and re-riveted for continued operation.

The cathode basket (which includes the upper basket 302 and the lower basket 306) is electrically isolated from the cathode plate 304. Each cathode assembly 300 is configured to engage two pairs of knife edge contacts 104 (four knife edge contacts 104) so as to receive power from two power supplies. For instance, the cathode plate 304 may receive a primary reduction current, while the cathode basket may receive a secondary current to control various byproducts of the reduction process. The cathode basket may be formed of a porous metal plate that is sufficiently open to allow molten salt electrolyte to enter and exit during the reduction process yet fine enough to retain the oxide feed material and resulting metallic product.

Stiffening ribs may be provided inside the cathode basket to reduce or prevent distortion. Where vertical stiffening ribs are provided in the lower basket 306, the cathode plate 304 will have corresponding slots to allow clearance around the stiffening ribs when the cathode plate 304 is inserted into the cathode basket. For instance, if the lower basket 306 is provided with two vertical stiffening ribs, then the cathode plate 304 will have two corresponding slots to allow clearance around the two stiffening ribs. Additionally, position spacers may be provided near the midsection of both faces of the cathode plate 304 to ensure that the cathode plate 304 will remain in the center of the cathode basket when loading the oxide feed material. The position spacers may be ceramic and vertically-oriented. Furthermore, staggered spacers may be provided on the upper section of both faces of the cathode plate 304 to provide a thermal break for radiant and conductive heat transfer to the top of the cathode assembly 300. The staggered spacers may be ceramic and horizontally-oriented.

The cathode assembly 300 may also include a lift bracket 308 with lift tabs 310 disposed on the ends. The lift tabs 310 are designed to interface with a lift system 400 (e.g., FIGS. 4-6) of the electrolytic oxide reduction system 100. As previously noted above, in addition to the disclosure herein, the cathode assembly may be as described in related U.S. application Ser. No. 12/978,005; filed on even date herewith; entitled "MODULAR CATHODE ASSEMBLIES AND METHODS OF USING THE SAME FOR ELECTROCHEMICAL REDUCTION," the entire contents of which is hereby incorporated by reference.

Figure 4:
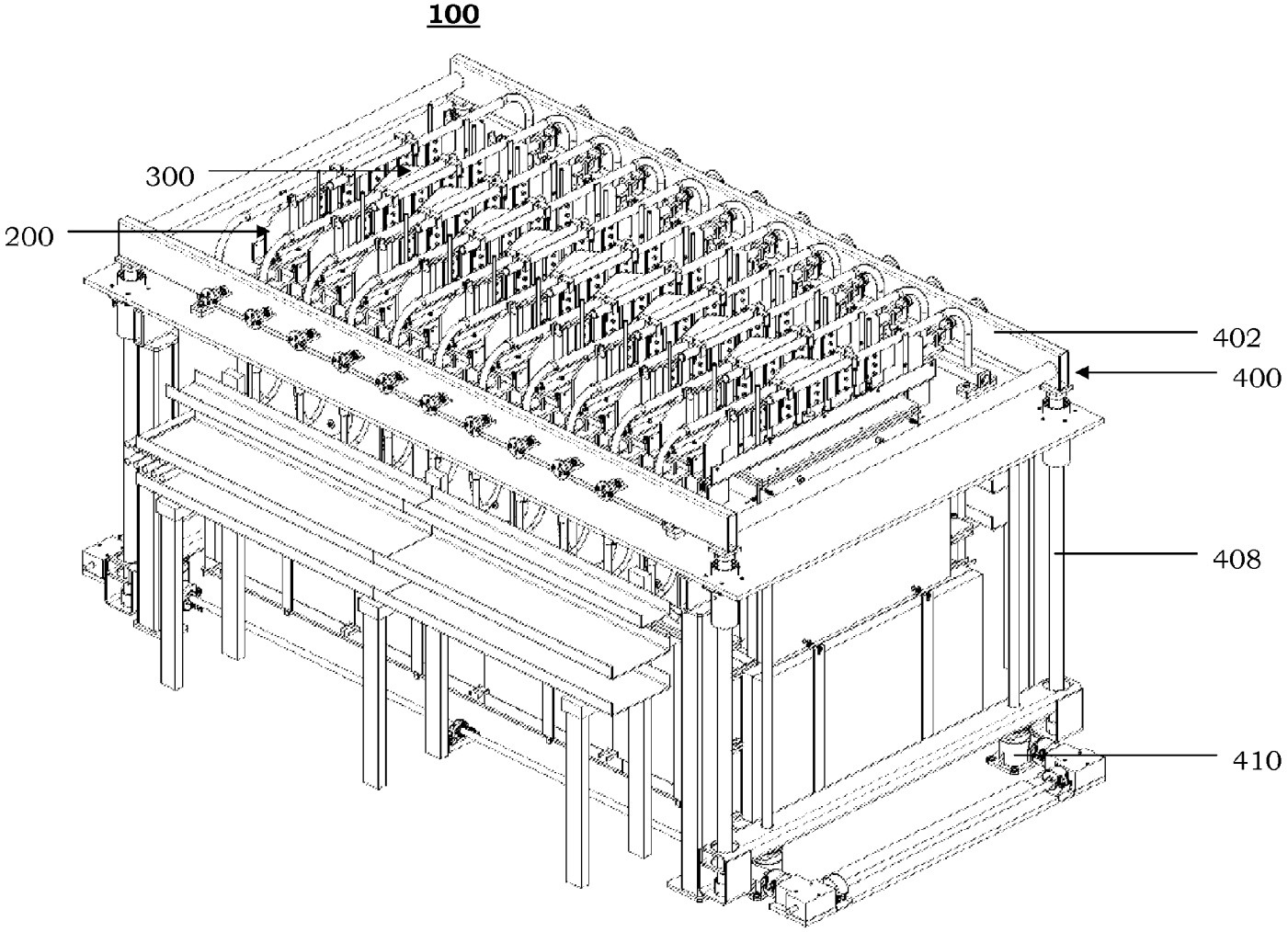
FIG. 4 is a perspective view of an electrolytic oxide reduction system with a lift system that is in a lowered position according to a non-limiting embodiment of the present invention.

FIG. 4 is a perspective view of an electrolytic oxide reduction system with a lift system that is in a lowered position according to a non-limiting embodiment of the present invention. Referring to FIG. 4, the lift system 400 includes a pair of lift beams 402 arranged along a lengthwise direction of the electrolytic oxide reduction system 100. The lift beams 402 may be arranged in parallel. A shaft 408 and a mechanical actuator 410 are associated with each end portion of the lift beams 402. In addition to the lift system 400, FIG. 4 also illustrates the plurality of anode and cathode assemblies 200 and 300 as arranged in the electrolytic oxide reduction system 100 during operation.

As discussed above, the electrolytic oxide reduction system 100 includes a plurality of anode assemblies 200, a plurality of cathode assemblies 300, and a lift system 400. Each anode assembly 200 includes a plurality of anode rods 202 having the same orientation and arranged so as to be within the same plane. The plurality of cathode assemblies 300 are alternately arranged with the plurality of anode assemblies 200 such that each cathode assembly 300 is flanked by two anode assemblies 200. Each cathode assembly 300 may also be in planar form. Although FIG. 4 illustrates the electrolytic oxide reduction system 100 as having eleven anode assemblies 200 and ten cathode assemblies 300, it should be understood that example embodiments are not limited thereto, because the modular design of the electrolytic oxide reduction system 100 allows for more or less of the anode and cathode assemblies 200 and 300 to be used.

The lift system 400 is configured to selectively engage the plurality of anode and/or cathode assemblies 200 and 300 so as to facilitate the simultaneous lifting of any combination of the plurality of anode and/or cathode assemblies 200 and 300 that are to be removed while allowing one or more of the plurality of anode and/or cathode assemblies 200 and 300 that are not to be removed to remain in place. Thus, all of the cathode assemblies 300 may be simultaneously removed with the lift system 400 or only one cathode assembly 300 may be removed.

The plurality of anode and cathode assemblies 200 and 300 are vertically oriented. The arrangement plane of the plurality of anode rods 202 of each anode assembly 200 may be parallel to the planar form of each cathode assembly 300. The spacing between the plurality of anode rods 202 of each anode assembly 200 may be greater than a distance between adjacent anode and cathode assemblies 200 and 300. The width of each cathode assembly 300 may be greater than a distance between adjacent anode and cathode assemblies 200 and 300, wherein the width is the dimension that extends from one lift beam 402 toward the other lift beam 402. The spacing between the plurality of anode rods 202 of each anode assembly 200 may be less than a width of each cathode assembly 300. In a non-limiting embodiment, the distance between adjacent anode and cathode assemblies 200 and 300 may be in the range of about 0.25 to 2.75 inches. For example, adjacent anode and cathode assemblies 200 and 300 may be spaced about 1.5 inches apart. Although various dimensions have been described above, it should be understood that other variations are also suitable with regard to optimizing the electric field lines within the electrolytic oxide reduction system 100 during operation.

The two parallel lift beams 402 of the lift system 400 extend along the alternating arrangement direction of the plurality of anode and cathode assemblies 200 and 300. The plurality of anode and cathode assemblies 200 and 300 are arranged between the two parallel lift beams 402. The two parallel lift beams 402 may extend in a horizontal direction. The shaft 408 of the lift system 400 is secured underneath both end portions of each lift beam 402. For example, the shaft 408 may be secured perpendicularly to both end portions of each lift beam 402. The mechanical actuators 410 of the lift system 400 are configured to drive the two parallel lift beams 402 in a vertical direction via the shafts 408. A mechanical actuator 410 is provided beneath each end portion of the two parallel lift beams 402.

The shaft 408 may extend through the glovebox floor 106 by way of a hermetic slide bearing. The hermetic slide bearing may include two bearing sleeves and two gland seals. The bearing sleeves may be formed of high molecular weight polyethylene. A space between the two gland seals may be pressurized with an inert gas (e.g., argon) using a port to 1.5-3" water column positive pressure (assuming a maximum glovebox atmosphere of 1.5" water column negative). The gland seals are designed to be replaced without compromising the glovebox atmosphere. An external water-cooled flange may connect the vessel 102 to the glovebox floor 106 so as to maintain a hermetic seal while limiting a temperature of the glovebox floor 106 to less than about 80° C.

Figure 5:
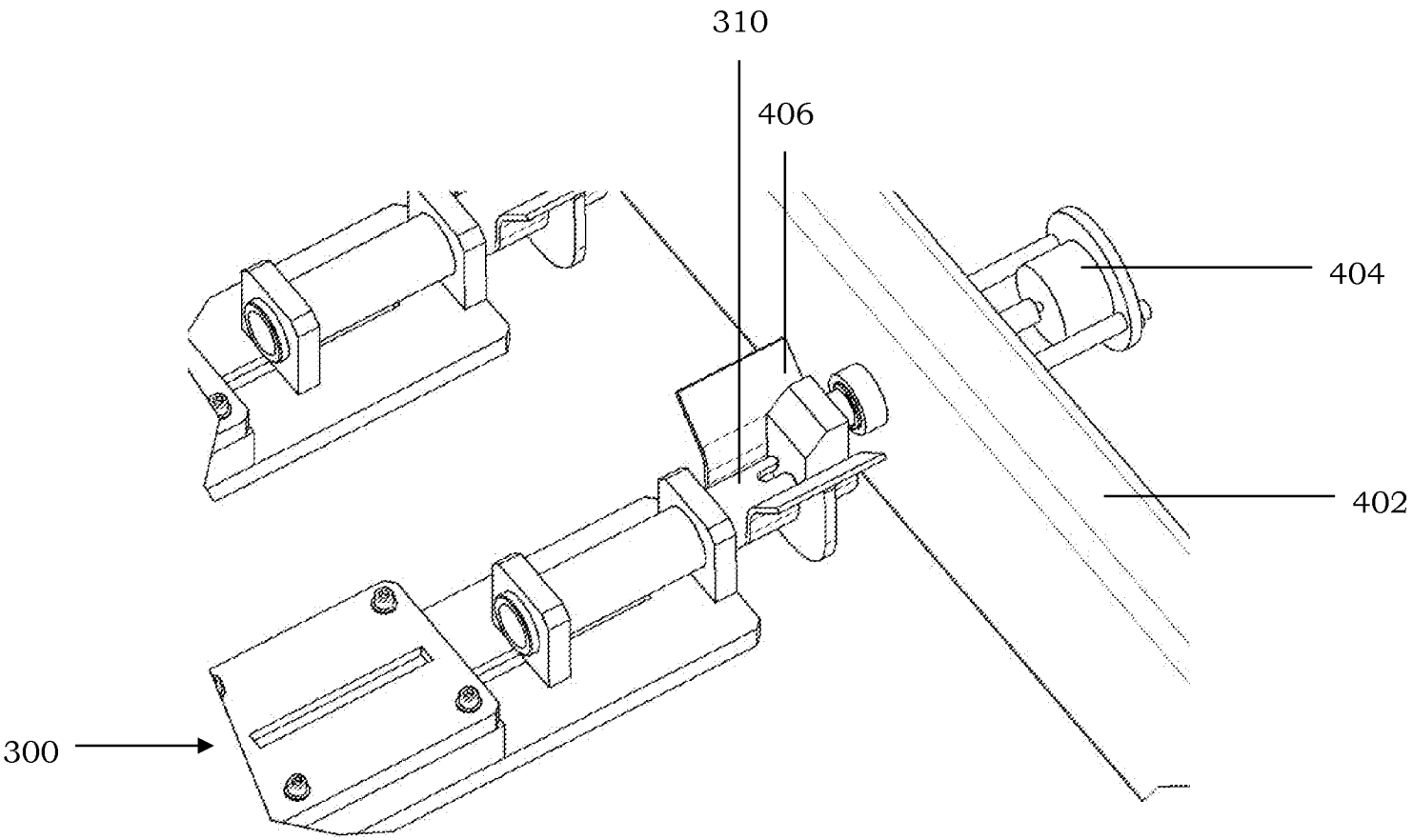
FIG. 5 is a partial view of a lift system of an electrolytic oxide reduction system according to a non-limiting embodiment of the present invention.

FIG. 5 is a partial view of a lift system of an electrolytic oxide reduction system according to a non-limiting embodiment of the present invention. Referring to FIG. 5, the lift system 400 includes a plurality of lift cups 406 dispersed along the longitudinal direction of each of the lift beams 402. Assuming the electrolytic oxide reduction system 100 has ten cathode assemblies 300 (although example embodiments are not limited thereto), ten lift cups 406 may be disposed on each lift beam 402 so as to provide two lift cups 406 for each cathode assembly 300. The lift cups 406 are disposed on the inner side surface of the parallel lift beams 402. The lift cups 406 may be U-shaped with the ends flaring outwards. However, it should be understood that the lift cups 406 are not limited to the structure illustrated in FIG. 5 but, instead, are intended to include other shapes and forms (e.g., hook) that are suitable for engaging the lift pin 310 of a cathode assembly 300.

Each lift cup 406 is provided with a solenoid 404, although example embodiments are not limited thereto. Each solenoid 404 is mounted on the opposing outer side surface of the lift beam 402 and is configured to drive (e.g., rotate) the corresponding lift cup 406. By providing each lift cup 406 with a solenoid 404, each lift cup 406 can be independently driven. However, it should be understood that the lift cups 406 (which may be in different shapes and forms) may also be operated in different ways so as to engage the lift pin 310 of a cathode assembly 300. For example, instead of being rotated, the lift cup 406 may be configured to extend to extend/retract so as to engage/disengage the lift pin 310 of a cathode assembly 300.

The lift cups 406 are arranged along each lift beam 402 such that a pair of lift cups 406 is associated with each of the plurality of cathode assemblies 300. A "pair" refers to a lift cup 406 from one lift beam 402 and a corresponding lift cup 406 from the other lift beam 402. The lift cups 406 are spaced along each lift beam 402 such that a pair of lift cups 406 will be aligned with the lift tabs 310 protruding from the side ends of each cathode assembly 300 of the electrolytic oxide reduction system 100. The lift cups 406 may be vertically aligned with the corresponding lift tabs 310. Each pair of the lift cups 406 is configured so as to be able to rotate and be positioned under the lift tabs 310 protruding from side ends of a corresponding cathode assembly 300. Otherwise, the lift cups 406 may be rotated so as to be positioned above the lift tabs 310.

Figure 6:
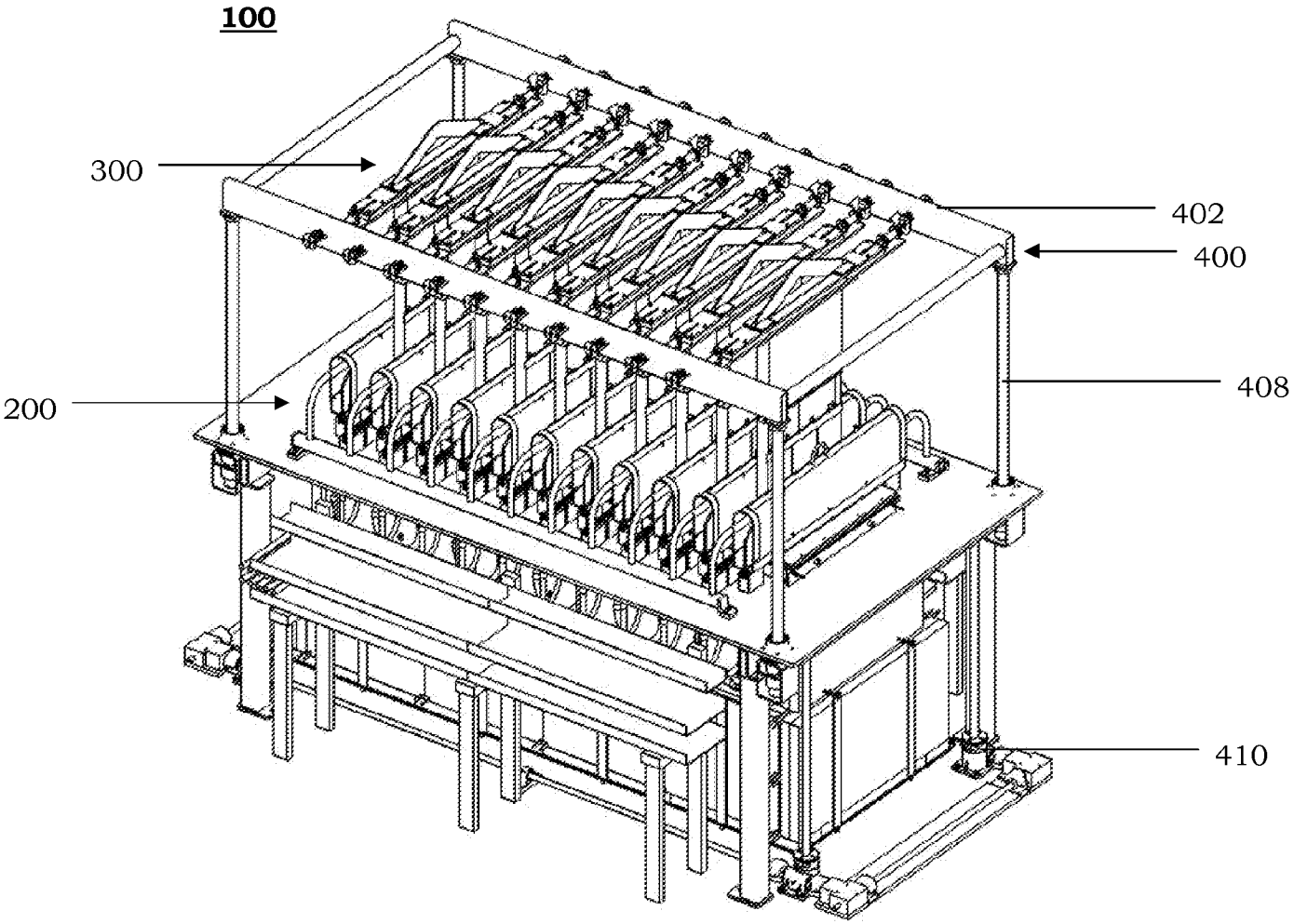
FIG. 6 is a perspective view of an electrolytic oxide reduction system with a lift system that is in a raised position according to a non-limiting embodiment of the present invention.

FIG. 6 is a perspective view of an electrolytic oxide reduction system with a lift system that is in a raised position according to a non-limiting embodiment of the present invention. Referring to FIG. 6, the lift system 400 may be employed during the operation or maintenance of the electrolytic oxide reduction system 100. For example, after the reduction process, the cathode assemblies 300 may be removed from the electrolytic oxide reduction system 100 with the lift system 400 to allow access to the metallic product. In the raised position, a portion of the cathode assembly 300 may remain under the cover of the vessel 102 so as to act as a heat block until ready for removal.

During the reduction process, the lift cups 406 may be inverted above the lift tabs 310 of the cathode assemblies 300. When one or more cathode assemblies 300 are to be removed, the lift beams 402 are lowered, and the lift cups 406 on the lift beams 402 are rotated by the solenoid 404 so as to be positioned under the lift tabs 310 of the cathode assemblies 300 to be removed. Next, the mechanical actuators 410 drive the shafts 408 upward in a vertical direction, thereby raising the parallel lift beams 402 along with the pertinent cathode assemblies 300. While in the raised position, an electrical lock-out may keep the lift cups 406 from actuating until the lift beams 402 have been fully lowered. This feature will ensure that the cathode assemblies 300 will not disengage while in the raised position. Once the cathode assemblies 300 with the metallic product has been retrieved and substituted with cathode assemblies 300 containing oxide feed material, the cathode assemblies 300 with the oxide feed material may be lowered into the molten salt electrolyte in the vessel 102 of the electrolytic oxide reduction system 100 via the lift system 400.

Alternatively, the cathode assemblies 300 may be removed from the electrolytic oxide reduction system 100 to allow for inspection, repairs, the replacement of parts, or to otherwise allow access to the portion of the vessel 102 that is normally occupied by the cathode assemblies 300. The lift process may be as described above. Once the pertinent maintenance or other activity has been performed, the cathode assemblies 300 may be lowered into the molten salt electrolyte in the vessel 102 of the electrolytic oxide reduction system 100 via the lift system 400. Although FIG. 6 shows all of the cathode assemblies 300 as being simultaneously removed when the lift system 400 is in the raised position, it should be understood that the lift system 400 is configured to allow the removal of anywhere from one to all of the cathode assemblies 300, wherein the cathode assemblies 300 may be adjacent or non-adjacent.

Although the above examples have focused on the removal of the cathode assemblies 300, it should be understood that the lift system 400 may be similarly configured and operated to raise/lower any combination of the anode assemblies 200. Once the anode assemblies 200 and/or cathode assemblies 300 are in the raised position, their removal from the lift system 400 may be achieved with another mechanism (e.g., crane) within the glovebox.

While a number of example embodiments have been disclosed herein, it should be understood that other variations may be possible. Such variations are not to be regarded as a departure from the spirit and scope of the present disclosure, and all such modifications as would be obvious to one skilled in the art are intended to be included within the scope of the following claims.

The invention claimed is:

1. An electrolytic oxide reduction system, comprising:

a plurality of anode assemblies, each anode assembly including a plurality of anode rods having the same orientation and arranged so as to be within the same plane;

a plurality of cathode assemblies alternately arranged with the plurality of anode assemblies such that each cathode assembly is flanked by two anode assemblies, each cathode assembly being in planar form, the plurality of anode and cathode assemblies including lift tabs protruding from side ends thereof; and a lift system including lift cups configured to selectively engage one or more of the plurality of anode assemblies, the plurality of cathode assemblies, or a combination thereof, the lift cups of the lift system being aligned with the lift tabs of the plurality of anode and cathode assemblies, each of the lift cups configured to independently rotate around a corresponding lift tab so as to be above the corresponding lift tab in a disengaged state and under the corresponding lift tab in an engaged state, wherein each of the lift cups includes a concave surface and an opposing convex surface, the concave surface facing a top surface of the corresponding lift tab during the disengaged state, the concave surface facing a bottom surface of the corresponding lift tab during the engaged state, the concave surface configured to receive and support the corresponding lift tab during lifting, the convex surface facing away from the top surface of the corresponding lift tab during the disengaged state, the convex surface facing away from the bottom surface of the corresponding lift tab during the engaged state.

2. The electrolytic oxide reduction system of claim 1, wherein the plane in which the plurality of anode rods of each anode assembly are arranged is parallel to the planar form of each cathode assembly.

3. The electrolytic oxide reduction system of claim 1, wherein the plurality of anode and cathode assemblies are vertically oriented.

4. The electrolytic oxide reduction system of claim 1, wherein a spacing between the plurality of anode rods of each anode assembly is greater than a distance between adjacent anode and cathode assemblies.

5. The electrolytic oxide reduction system of claim 1, wherein a width of each cathode assembly is greater than a distance between adjacent anode and cathode assemblies.

6. The electrolytic oxide reduction system of claim 1, wherein a spacing between the plurality of anode rods of each anode assembly is less than a width of each cathode assembly.

7. The electrolytic oxide reduction system of claim 1, wherein a distance between adjacent anode and cathode assemblies is in the range of 0.25 to 2.75 inches.

8. The electrolytic oxide reduction system of claim 1, wherein the lift system includes two parallel lift beams extending along a direction that the plurality of anode and cathode assemblies are alternately arranged.

9. The electrolytic oxide reduction system of claim 8, wherein the plurality of anode and cathode assemblies are arranged between the two parallel lift beams.

10. The electrolytic oxide reduction system of claim 8, wherein the two parallel lift beams extend in a horizontal direction.

11. The electrolytic oxide reduction system of claim 8, wherein the lift system further includes a shaft secured underneath both end portions of each lift beam.

12. The electrolytic oxide reduction system of claim 11, wherein the shaft is secured perpendicularly to both end portions of each lift beam.

13. The electrolytic oxide reduction system of claim 8, wherein the lift system includes mechanical actuators configured to drive the two parallel lift beams in a vertical direction.

14. The electrolytic oxide reduction system of claim 8, wherein the lift system includes a mechanical actuator beneath each end portion of the two parallel lift beams.

15. The electrolytic oxide reduction system of claim 1, further comprising:

an externally heated vessel configured to receive the plurality of anode and cathode assemblies, the externally heated vessel provided with longitudinal supports and formed of a material that can withstand temperatures up to 700° C. so as to be able to hold molten salt electrolyte.

16. The electrolytic oxide reduction system of claim 15, wherein the externally heated vessel is configured for zone heating to allow for more efficient operation and recovery from process upsets.

17. The electrolytic oxide reduction system of claim 15, further comprising:

modular heat shields designed to limit heat loss from the externally heated vessel.

18. The electrolytic oxide reduction system of claim 17, wherein the modular heat shields have instrumentation ports configured to monitor current, voltage, and off-gas composition during process operations.

19. The electrolytic oxide reduction system of claim 15, further comprising:

an external water-cooled flange connecting the externally heated vessel to a floor of a glovebox so as to maintain a hermetic seal while limiting a temperature of the floor to less than 80° C.

20. The electrolytic oxide reduction system of claim 1, wherein the cathode assembly includes a cathode basket and a cathode plate housed within the cathode basket, the cathode basket being electrically isolated from the cathode plate, the cathode basket formed of a porous metal plate, the porous metal plate being sufficiently open to allow molten salt electrolyte to enter and exit during a reduction process yet fine enough to retain an oxide feed material and a resulting metallic product.

21. The electrolytic oxide reduction system of claim 1, wherein the concave surface and the opposing convex surface are configured to rotate around an outer surface of the corresponding lift tab, the convex surface facing away from the outer surface of the corresponding lift tab during the disengaged and engaged states.

* * * * *